US006508488B1

(12) United States Patent
Becker

(10) Patent No.: US 6,508,488 B1
(45) Date of Patent: Jan. 21, 2003

(54) BOOK CONTAINING MODEL COMPONENTS COMBINABLE TO FORM A THREE DIMENSIONAL MODEL

(75) Inventor: James F. Becker, Bellevue, WA (US)

(73) Assignee: becker & mayer!, Bellevue, WA (US)

( * ) Notice: Subject to any disclaimer, the term of this patent is extended or adjusted under 35 U.S.C. 154(b) by 0 days.

(21) Appl. No.: 09/989,959

(22) Filed: Nov. 21, 2001

(51) Int. Cl.[7] ..... B42D 1/00

(52) U.S. Cl. ..... 281/38; 281/15.1; 434/267; 434/269; 434/274; 434/317; 446/147

(58) Field of Search ..... 281/15.1, 22, 38, 281/51; 273/157 R; 434/262, 267, 269, 272, 274, 317; 446/71, 72, 73, 75, 146, 147

(56) References Cited

U.S. PATENT DOCUMENTS 2,678,505 A * 5/1954 Munson ..... 434/272
2,862,309 A * 12/1958 Von Der Hellen ..... 273/157 R
2,918,731 A * 12/1959 Warhaftig et al. ..... 101/32
2,946,137 A * 7/1960 Worth et al. ..... 283/46
3,020,652 A * 2/1962 Ferrari et al. ..... 35/17
3,191,319 A * 6/1965 Waisgerber ..... 206/232
4,176,473 A 12/1979 Rae ..... 35/35 E
5,915,729 A 6/1999 Vap ..... 281/22
5,980,354 A * 11/1999 Prest ..... 434/171
6,224,106 B1 * 5/2001 Murphy ..... 281/15.1
6,319,088 B1 * 11/2001 Cole et al. ..... 446/147

* cited by examiner

*Primary Examiner*—A. L. Wellington
*Assistant Examiner*—Monica Carter
(74) *Attorney, Agent, or Firm*—Graybeal Jackson Haley LLP

(57) ABSTRACT

The invention provides a book containing a three dimensional model assembly made from a plurality of model components attached to respective pages in the book. The model can be a human body or anything desired. When the book is closed, the model components combine to form a completely assembled model assembly that is thinner than the book. Thus, the book can lie flat on either its front or back cover on a flat surface. When the book is open, and as a reader turns each page, the model components attached to the respective page separate from the model assembly revealing other components that remain combined to form a partially assembled model assembly. The components can be fixedly or hingedly attached to respective pages with bars, flaps or both. If hingedly attached, the model components can be separated from the model assembly without turning a respective page.

27 Claims, 4 Drawing Sheets

BOOK CONTAINING MODEL COMPONENTS COMBINABLE TO FORM A THREE DIMENSIONAL MODEL

TECHNICAL FIELD

The present invention relates to the field of books. More particularly, this invention relates to books containing a multi-part three dimensional model.

BACKGROUND

A multi-part three dimensional model is worth a thousand words. A person typically learns more, quicker, when he/she can observe, touch, study the parts of a model in three dimensions. With a quick study of model parts, a person gains information that typically requires paragraphs if not pages of text to develop and explain. For example, a three dimensional model of the parts of a human body can quickly convey to a person the numbers and shapes of bones in the arms, legs, hands, and fingers, as well as the proportional sizes of the arms to the legs, the hands to the feet, the fingers to the toes, and the hands to body. To receive this same information from text, a reader typically has to read one or more pages. In addition, studying a three dimensional model typically increases a person's attention and thus increases the person's comprehension. When combined with text to convey information, a three dimensional multi-part model becomes even more powerful.

The prior art contains books that include three dimensional multi-part models within a book; however the books contain models that are thicker than the book. Thus, a portion of the model protrudes through the front cover or back cover or both. This can be expensive to a manufacturer when he/she ships the book to a vendor because to secure the books within a box, special packing inserts or packing material must be placed between each book. A model protruding from one or both of the covers of a book can also be frustrating to a vendor or purchaser of the book because the book can not be stacked with other books and will not fit neatly on a shelf. Thus, a book containing a three dimensional multi-part model that does not protrude from the front cover, back cover or both is very desirable.

In addition, the books found in the prior art include components that are not attached to other components of the model or any page in the book but rather are stored in one or more pockets in one or more pages. To assemble the model, the reader must first find and retrieve the loose component and then combine it with another component using written instructions provided on a page. Unfortunately, these books suffer three drawbacks. First, the reader may inadvertently combine the components of the model incorrectly by misunderstanding the written instructions, and thus, misunderstand some of the information conveyed by the components and assembled model. Second, the reader typically has to hold the components in their proper location and thus can not typically assemble more than two components together. Finally, in these books, the components can be easily lost depriving subsequent readers of the informational value of the lost component as well as the assembled model.

Therefore there is need for a book that contains a three dimensional multi-part model that does not protrude from the front or back cover. There is also a need for a book that contains a three dimensional model made from components attached to the book that can be combined with other components to assemble the model or can be separated from the model. Such a book would allow the reader to study the individual components as well as how the components combine to make the model. This allows the user to better understand and fully comprehend the information the model and the components convey.

SUMMARY

In one aspect of the present invention, a book includes a plurality of pages bound together with each page having a page thickness, and a plurality of model components including a first model component attached to a page and a second model component attached to another page such that, when the book is closed, the model components combine with each other to form a model assembly. The model assembly has an assembly thickness less than or equal to the sum of the page thicknesses, thus, allowing the book to lie substantially flat on a surface when either the cover or back of the book contacts the surface. In addition, the book can be shipped, displayed and stored much easier and more efficiently than a book having a portion of its three dimensional model protruding from one of its covers. When the book is opened, because components are attached to different pages, the model assembly is partially unassembled and, by turning successive pages, the model assembly becomes increasingly disassembled. This allows a reader to maintain interest in the subject matter and also provides the reader with information that is typically difficult to comprehend without seeing how the components combine.

In another aspect of the invention, the book includes a plurality of model components each having a component thickness greater than the page thickness of the component's respective page. At least one component is hingedly attached to a page and movable about a component axis disposed on a surface of the page to an assembled position where the component is combined with another component to form a model assembly when the book is closed. By hingedly attaching at least one component to a page, a reader can remove the hinged component from the model assembly without having to turn the page and without disconnecting the component from the book.

In another aspect of the invention, the book includes at least one page hingedly attached to another page to form a binding axis which is not located on a spine of the book. In this and certain other embodiments, each page of the book includes a first edge and a second edge. The spine is formed by binding the first edges of most of the pages to each other, and the binding axis is formed by binding the second edge of at least one page to the second edge of another page.

DETAILED DESCRIPTION

All terms used herein, including those specifically described below in this section, are used in accordance with their ordinary meanings unless the context or definition indicates otherwise. Also, unless indicated otherwise, except within the claims, the use of "or" includes "and" and vice-versa. Non-limiting terms are not to be construed as limiting unless expressly stated (for example, "comprising" means "including without limitation" unless expressly stated otherwise).

Figure 1:
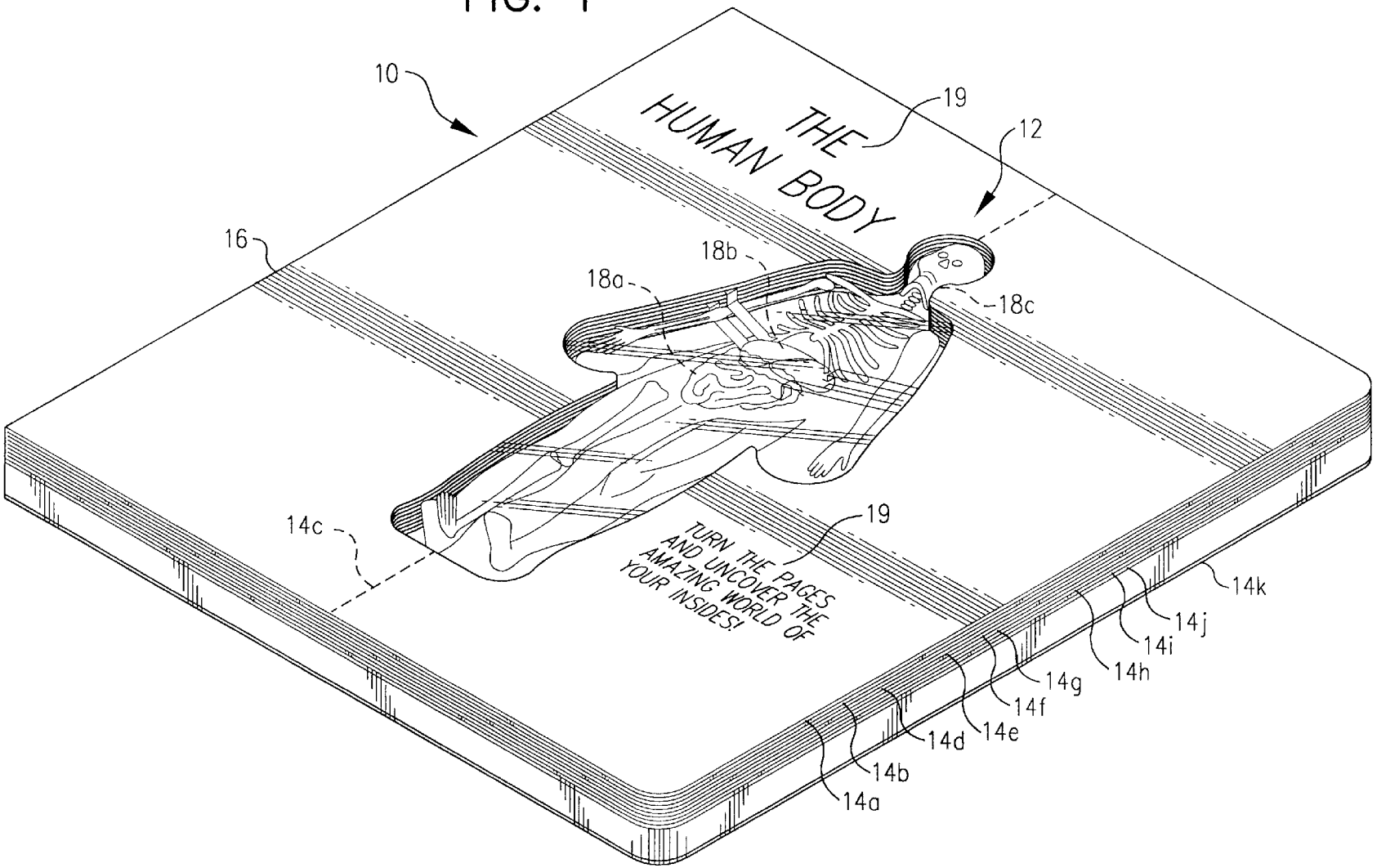
FIG. 1 is a perspective view of a book with a three dimensional model according to an embodiment of the invention.

FIG. 1 is a perspective view of a book 10 that includes a model assembly 12 according to an embodiment of the invention. The book 10 includes a plurality of pages 14*a*–14*k* that are bound together to form a spine 16, and a plurality of model components 18*a*–18*c* (18*d*–18*f* not shown) attached to respective pages 14*a*–14*k* and combinable to form the model assembly 12. Zero or one or more model components can be attached to a single page. When the book 10 is closed as shown in FIG. 1, the model assembly 12 is completely contained within the book 10. More particularly, the book 10 can lie flat on either page 14*a* or 14*k*—typically the book's front cover and back cover, respectively. This allows one to ship, display and store the book much easier and more efficiently than a book having a portion of its three dimensional model protruding from one of its covers.

Figure 3:
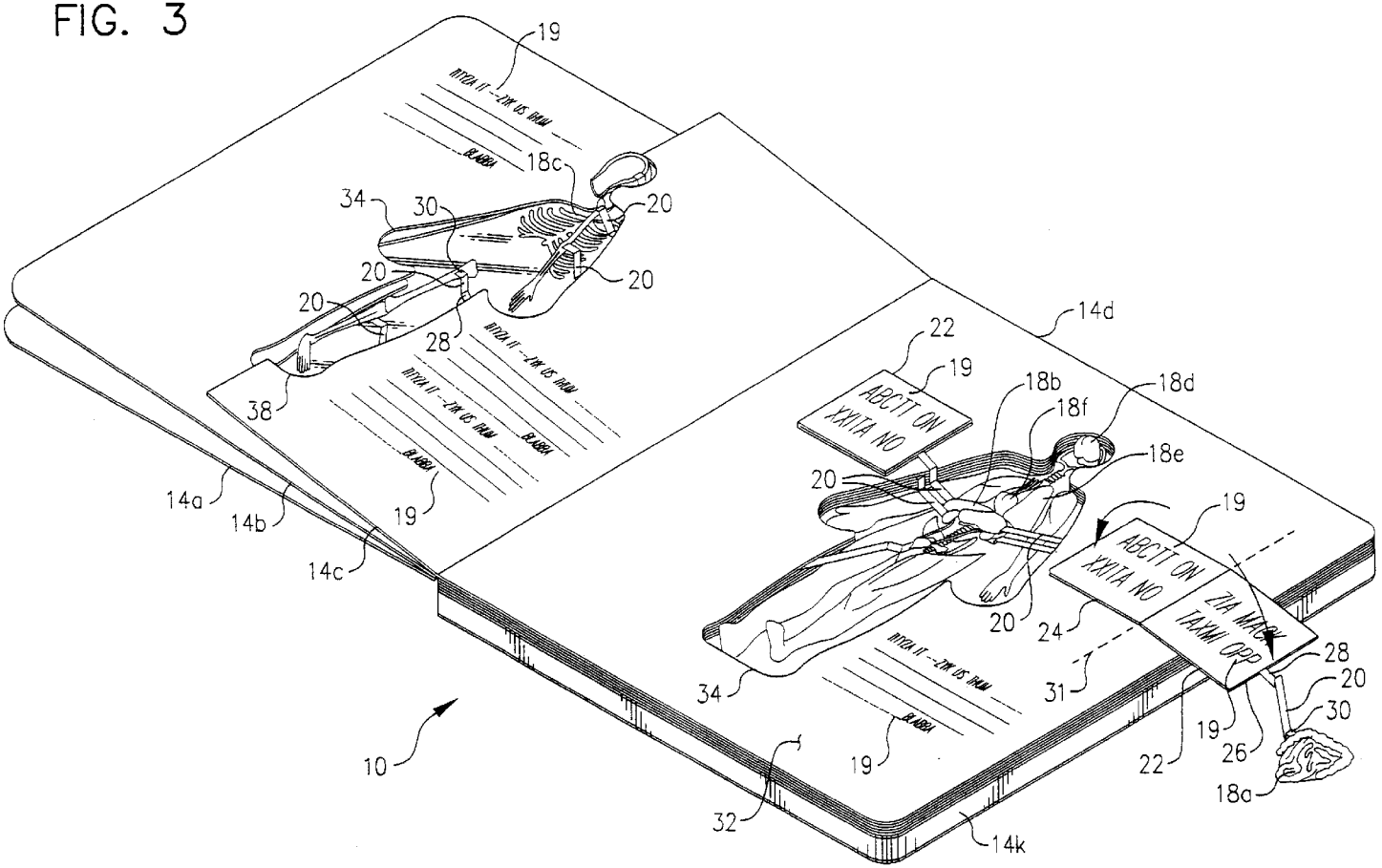
FIG. 3 is a perspective view of the book in FIG. 1 opened and showing components of the model attached to the pages of the book according to the embodiment of the invention.

In addition, the model components 18*a*–18*f* combine to form the model assembly 12 in a completely assembled state. When the book is opened (for example, as shown in FIG. 3), one or more model components 18*a*–18*f* (for example, 18*c* as shown in FIG. 3) are separated from the model assembly 12, while one or more other model components 18*a*–18*f* (for example, 18*a*, 18*b*, 18*d*–18*f* as shown in FIG. 3) remain combined to form the model in a partially assembled state. As a reader turns the pages 14*a*–14*k*, one or more model components 18*a*–18*f* are separated from the model assembly 12 to reveal the model assembly in partially assembled states that progressively include fewer and fewer combined model components. Thus, as the reader turns each page 14*a*–14*k*, the reader is able to study the one or more components 18*a*–18*f* attached to the turned page 14*a*–14*k*, the remaining partially assembled model, and the differences between the partially assembled model before and after turning each page 14*a*–14*k*. This increases the readers attention to and comprehension of the information conveyed by the book.

The model assembly 12 can represent any desired machine, organism, structure or system. In the depicted embodiment and certain other embodiments, the model assembly represents a human body and the model components 18*a*–18*f* include representations of the intestines 18*a*, the liver 18*b*, a portion of the skeletal system 18*c* and the brain 18*d* shown in FIG. 3. The components 18*a*–18*f* are attached to respective pages 14*a*–14*k* so that as a reader turns succeeding pages 14*a*–14*k*, the model is disassembled in layers progressing from the anterior side of the model to the posterior side. For example, as shown in FIG. 3 starting with page 14*c*, the first model component separated from the model assembly 12 is a portion of the skeletal system 18*c*. Then, as the reader turns the next page 14*d* the next model components separated from the model assembly 12 are the intestines 18*a* and liver 18*b*.

In other embodiments, the model assembly can represent a race car with the model components representing the body, engine, wheels, chassis and any other desired part of a race car. Or, the model assembly can represent an internal combustion engine with the model components representing the cam shaft, the head, the valves, the springs, the crankshaft, the carburetor and any other desired parts of an engine. In still other embodiments, the book can include two or more model assemblies, for example, one model assembly can represent a car and another model assembly can represent the engine of the car, or one model assembly can represent one car and another model assembly can represent a different car.

Still referring to FIG. 1, in this and certain other embodiments, the model components 18*a*–18*f* are three dimensional components each having a thickness that is typically greater than the thickness of the page it is attached to. However, the model components 18*a*–18*f* can be thinner than the respective pages 14*a*–14*k* they are attached to. For example, the last page 14*k* is typically thicker than the model component (not shown) attached to it. Alternatively, any one or more of the pages or all of the pages can be fabricated to be exceptionally thick to achieve the desired total thickness of the book. But, as discussed above, the thickness of the model assembly 12 in the completely assembled state is less than the thickness of the book when closed. The model components 18*a*–18*f* are typically made from any desired material such as conventional plastic, metal or fabric and can be formed using conventional molding techniques such as die casting or injection molding, or they can be formed by stuffing and stitching fabric, assembling sub-components together or any other desired manufacturing technique.

Figure 2A:
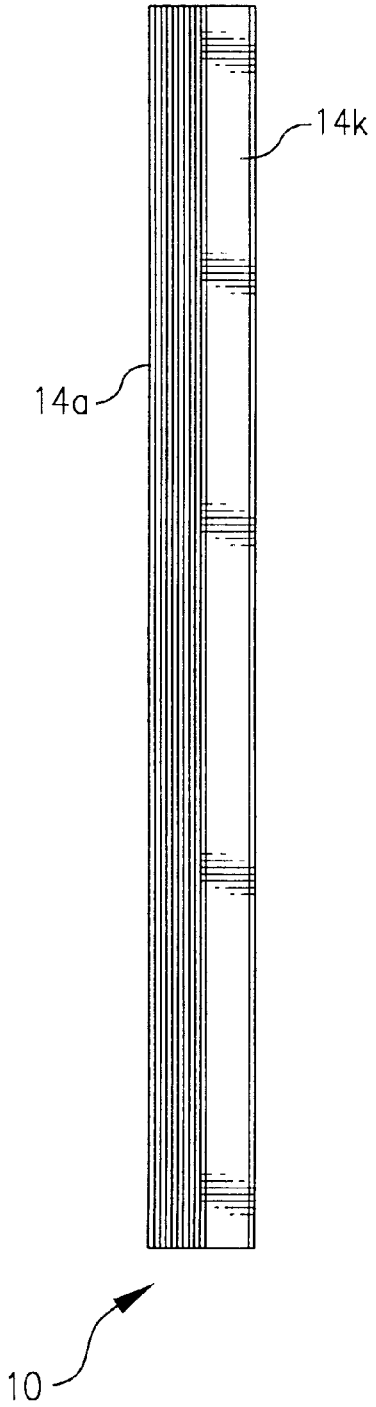
FIG. 2A is a side view of the book in FIG. 1 according to an embodiment of the invention.
Figure 2B:
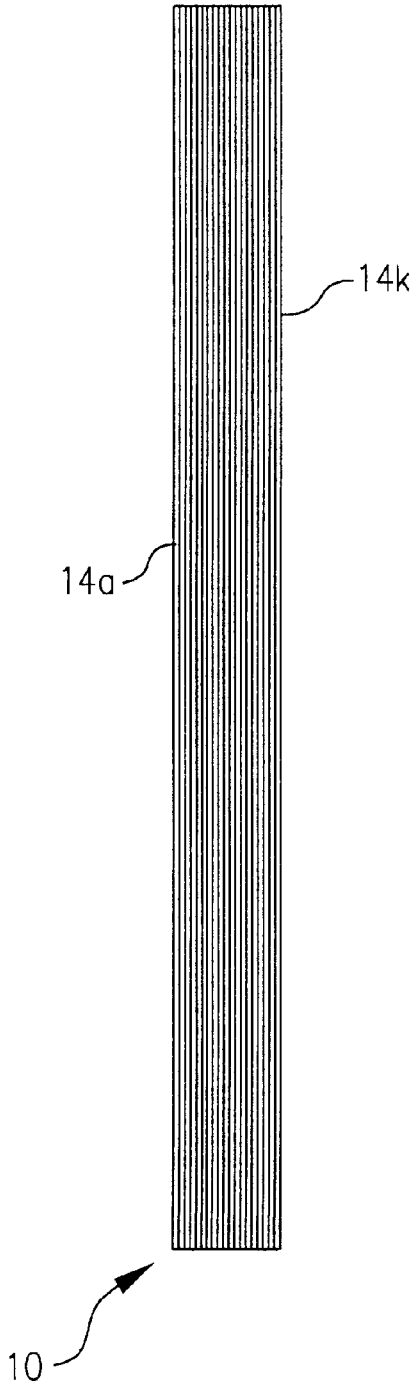
FIG. 2B is a side view of a book with a three dimensional model according to another embodiment of the invention.

Still referring to FIG. 1, in this and certain other embodiments, the pages 14*a*–14*k* include text 19 and are hingedly bound together to form the spine 16 using conventional binding techniques. For example, the pages 14*a*–14*k* can be stitched together, glued together, stitched or glued to an additional backing material (not shown), hole punched and inserted into binder rings or a spiral, or bound together in any desired manner that allows a reader to turn one or more pages 14*a*–14*k* at time. The pages 14*a*–14*k* also have a page thickness that can vary, for example, page 14*k* is thicker than the other pages 14*a*–14*j* as shown in FIGS. 1 and 2*a*. In other embodiments, each of the page's thickness is the same or approximately the same as shown in FIG. 2*b*. The pages 14*a*–14*k* can be made from any conventional material such as cardboard, paper, laminated paper and foam, plastic, fabric or any other desired material. The text 19 can convey information relating to the model components 18*a*–18*f*, to the model assembly 12, or any other desired information.

FIG. 3 is a perspective view of the book 10 in an open position according to an embodiment of the invention. In this and certain other embodiments, the book also includes bars 20 and flaps 22 that attach one or more model components 18*a*–18*f* to respective pages 14*a*–14*k*. Each flap 22 includes a flap-attachment portion 24 attached to one of the pages 14*a*–14*k*, and a flap portion 26 both of which can include text 19. Each bar 20 includes a first end 28 attached to either one of the pages 14*a*–14*k* or one of the flap portions 26, and a second end 30 attached to one or more of the components 18*a*–18*f*. The bars 20 and flaps 22 can be located anywhere on respective pages 14*a*–14*k* that allows respective model components 18*a*–18*f* to combine with other model components 18*a*–18*f* when the book 10 is closed and allows respective model components 18*a*–18*f* to be separated from the model assembly 12 as a reader either turns the pages 14*a*–14*k* or moves the component which hinges on its flap or bar end.

In this and certain other embodiments, the flaps 22 are hingedly attached to respective pages 14*a*–14*k* to allow a reader to separate one or more of the model components 18*a*–18*f* from the model assembly 12 without turning one of the pages 14*a*–14*k*. To hingedly attach one or more of the flaps 22, one can attach the respective flap-attachment portions 24 to respective surfaces 32 of the respective pages 14*a*–14*k* using conventional techniques, such as gluing, taping, stapling, or any other desired technique, and then folding the flap-attachment portions 24 to establish respective model component axes 31. As a reader moves one or more of the model components 18*a*–18*f* attached to respective flaps 22, the flap portion 26 hinges about its respective component axis 31. Typically, the component axes 31 lie within the same plane as the page's surface 32 and are located a substantial distance away from the spine 16. However, one or more of the component axes 31 can lie in other planes inclined away from surface 32 of the one or more pages 14*a*–14*k* and can be located in any desired location on the page conducive to separating and combining the model components 18*a*–18*f*. In other embodiments, the flaps 22 can be hingedly attached to one of the pages 14*a*–14*k* by attaching the flap-attachment portion 24 to a hinge made of conventional metal, plastic or fabric. In still other embodiments, one or more of the model components 18*a*–18*f* can be hingedly attached directly to one or more of the pages 14*a*–14*k*, for example one or more bars 20 can be hingedly attached to respective pages 14*a*–14*k*.

In this and certain other embodiments, one or more bars 20 are made from conventional resilient plastic that is transparent to allow the reader to see the model components 18*a*–18*f* attached to succeeding or preceding pages 14*a*–14*k*. This provides the reader with a better view of the remaining model components 18*b*–18*f* that are combined to form the model assembly 12 in a partially assembled state as well as the underside of the model components 18*a*–18*e* that are separated from the model assembly 12. In other embodiments, one or more bars 20 can be made from any conventional material such as metal wire or rod, resilient rubber or plastic, or any other desired material strong enough to support one or more of the components 18*a*–18*f* that the bars 20 attach to respective pages 14*b*–14*k*. One or more flaps 22 can be made from any conventional material such as cardboard, paper, laminated paper, plastic, fabric or any other desired material.

Still referring to FIG. 3, in this and certain other embodiments, some or all of the pages 14*a*–14*k* include a profiled edge 38. The profiled edge 38 allows the book 10 to lie flat on either page 14*a* or 14*k*, respectively, when the book is closed. In other words, one or more model components 18*a*–18*f* do not protrude from the front cover—page 14*a*—or back cover—page 14*k*—of the book 10. Typically, the profiled edge 38 is a continuous profiled edge 34 that defines a hole in the page and lies adjacent and surrounds a portion of the model assembly 12 when the book 10 is closed. However, the profiled edge 38 can define a cut-out that lies adjacent to but does not surround a portion of the model assembly 12. For example, page 14*c* has a surface area that is approximately half of the surface area of pages 14*a*, 14*b*, and 14*d*–14*k*. In other embodiments, one or more pages 14*a*–14*k* can have a profiled edge 38 that defines a cut-out and have a surface area that is greater than or less than half of the surface area of one or more of the other pages 14*a*–14*k*. In addition one or more pages 14*a*–14*k* can have more than one profiled edge 38, profiled continuous edge 34 or a combination of both shapes of edges. All of the pages can have a profiled edge such that the model is located at the edge of the book (and each page) and is not surrounded by any page. Furthermore, the profiled edge 32 can be located a substantial distance away from the model assembly 12 when the book is closed.

Figure 4:
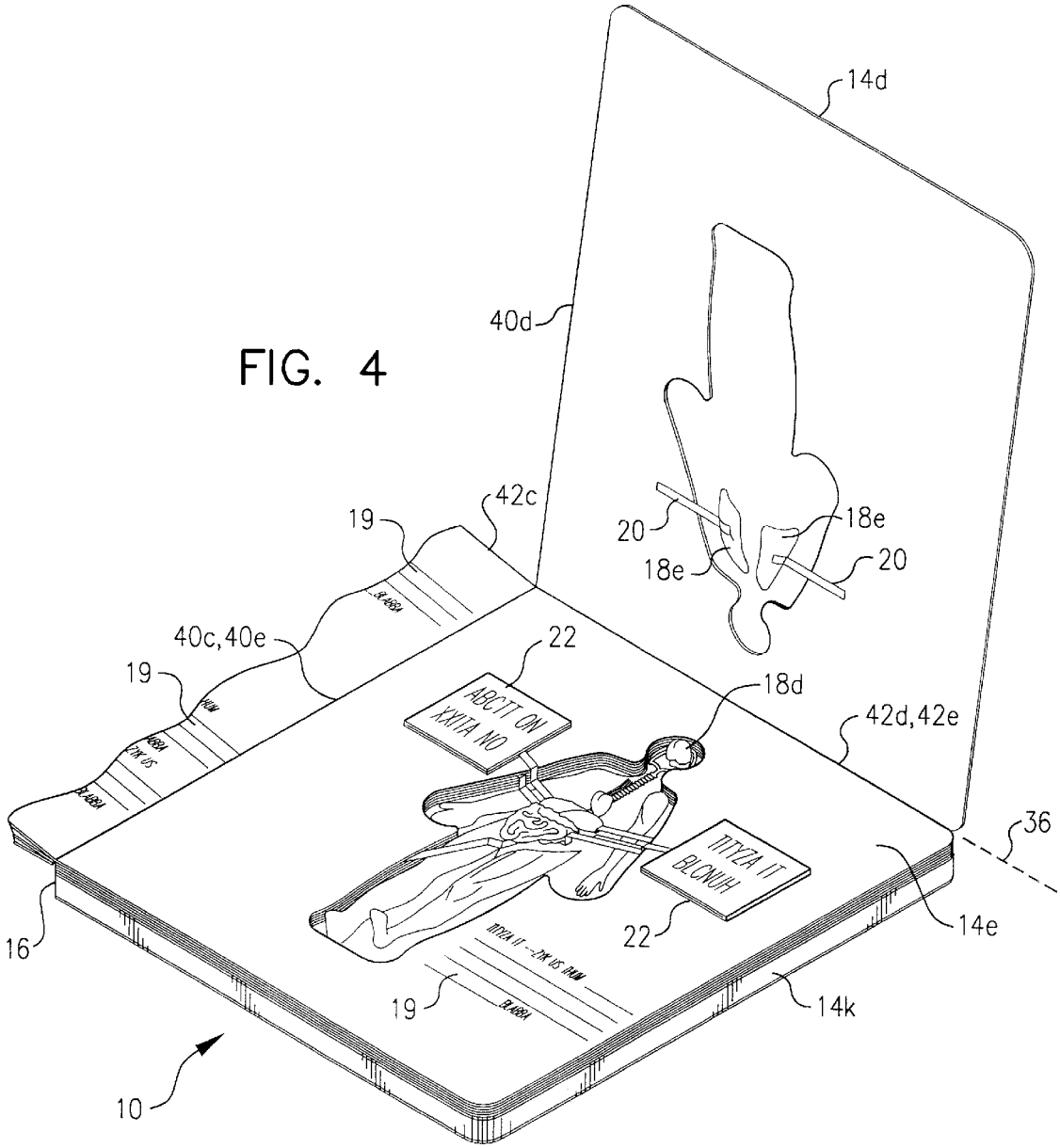
FIG. 4 is a perspective view of a book with a three dimensional model according to another embodiment of the invention.

FIG. 4 is a perspective view of a book 10 according to another embodiment of the invention. The book includes one or more pages 14*d* that are not bound to the other pages 14*k* at the spine 16, but rather, are bound to respective one or more other pages 14*e* at a binding axis 36 that is not at the spine. In this and certain other embodiments, each page 14*a*–14*k* includes a first edge 40*a*–40*k* (40*a*, 40*b*, 40*f*–40*k* not shown) and a second edge 42*a*–42*k* (42*a*, 42*b*, 42*f*–42*k* not shown). The first edges 40*a*–40*c* and 40*e*–40*k* of the pages 14*a*–14*c* and 14*e*–14*k* are hingedly attached to each other to form a spine 16 as previously discussed in conjunction with FIG. 1. The second edges 42*d* and 42*e* of the respective pages 14*d* and 14*e* are hingedly attached to each other to form a binding axis 36 that is substantially perpendicular to the spine 16. The second edge 42*d* can be hingedly attached to the second edge 42*e* using conventional binding techniques such as stitching, gluing, or folding one large piece of material that comprises the two pages 14*d* and 14*e* to form the two pages 14*d* and 14*e* or any other desired technique. In other embodiments, the binding axis can be oriented relative to the spine 16 at any desired angle other that 90 degrees.

Although the book has been described in considerable detail with reference to certain embodiments for purposes of illustration, other embodiments are possible, therefore the spirit and scope of the appended claims should not be limited to the above description of the embodiments; the present inventions include suitable modifications as well as all permutations and combinations of the subject matter set forth herein.

What is claimed is:

1. A book with a three dimensional model, comprising:

a plurality of pages bound together, each page having a page thickness;

a plurality of model components including a first model component attached to a page and a second model component attached to another page such that, when the book is closed, the model components combine with each other to form a model assembly having an assembly thickness less than or equal to a sum of the page thicknesses.

2. The book of claim 1 wherein at least one of the model components is hingedly attached to a page and is separable from another model component by moving the hinged model component relative to the page to which it is attached.

3. The book of claim 1 wherein one or more of the pages include a profiled edge located such that, when the book is closed, the profiled edge is adjacent the model assembly.

4. The book of claim 1 wherein at least one of the pages includes one continuous profiled edge defining a hole in the page and located such that, when the book is closed, the continuous profiled edge surrounds a portion of the model assembly.

5. The book of claim 1 wherein each page has a first edge and all the first edges are bound together.

6. The book of claim 1 wherein each page has a first edge and a second edge, the first edge of a at least one page is hingedly attached to the first edge of another page, and the second edge of the at least one page is hingedly attached to the second edge of yet another page.

7. The book of claim 1 wherein the plurality of pages includes a last page having a page thickness greater than any of the-other page thicknesses and wherein one of the model components is attached to the last page.

8. The book of claim 1 wherein at least one page includes text.

9. The book of claim 1 wherein the model assembly includes a model of a human body.

10. The book of claim 1 wherein:

the first model component is a human skeletal system component;

the second model component is a human liver component;

a third model component is a human brain component; and the model assembly is a model of a human body.

11. The book of claim 1 wherein:

the first model component is a human liver component hingedly attached to one of the pages;

the second model component is a human intestines component hingedly attached to the same page; and the model assembly is a model of a human body.

12. The book of claim 1 further comprising:

a flap including an attachment portion hingedly attached to one of the pages and a flap portion; and a bar including a first end attached to the flap portion and a second end attached to a component.

13. The book of claim 1 further comprising:

a flap including an attachment portion hingedly attached to one of the pages, a flap portion, and text; and a bar including a first end attached to the flap portion and a second end attached to a component.

14. The book of claim 1 further comprising:

a flap including an attachment portion hingedly attached to one of the pages and a flap portion; and a bar transparent to light and including a first end attached to the flap portion and a second end attached to a component.

15. A book with a three dimensional model, comprising:

a plurality of pages hingedly bound together to form a spine, each page having a page thickness; and a plurality of model components each attached to a page and each having a component thickness greater than the components respective pages thickness wherein at least one of the components is hingedly attached to its respective page and movable about a component axis disposed on a surface of the page to an assembled position where the component is combined with another component to form a model assembly when the book is closed; and the component axis is separated from the spine by a substantial distance.

16. The book of claim 15 wherein some of the pages include a profiled edge located such that, when the book is closed, the profiled edges are adjacent the model assembly.

17. The book of claim 15 wherein at least one of the pages includes one continuous profiled edge defining a hole in the page and located such that, when the book is closed, the continuous profiled edge surrounds a portion of the model assembly.

18. The book of claim 15 wherein each page includes a first edge and all the first edges are bound together to form the spine.

19. The book of claim 15 wherein each page includes a first edge and a second edge, the second edge of a first page is hingedly attached to the second edge of a second page thereby defining a binding axis, and the first edges of the first page and the remaining pages other than the second page are hingedly attached to each other to form the spine.

20. The book of claim 15 wherein the page thickness of each page is approximately the same.

21. The book of claim 20 wherein the page thickness of each page is the same.

22. The book of claim 15 wherein at least one page includes text.

23. The book of claim 15 wherein the model assembly includes a model of a human body.

24. The book of claim 15 wherein:

the model components include a human brain component, a human skeletal system component, a human liver component hingedly attached to one of the pages, and a human intestines component hingedly attached to the same page; and the model assembly is a model of a human body.

25. The book of claim 15 further comprising:

a flap including an attachment portion hingedly attached to one of the pages and a flap portion; and a bar including a first end attached to the flap portion and a second end attached to one of the components.

26. The book of claim 15 further comprising:

a flap including an attachment portion hingedly attached to one of the pages and a flap portion; and a bar transparent to light and including a first end attached to the flap portion and a second end attached to a component.

27. The book of claim 15 further comprising:

a flap including an attachment portion hingedly attached to one of the pages, a flap portion and text; and a bar including a first end attached to the flap portion and a second end attached to one of the components.

* * * * *